US005630983A

United States Patent [19]

Tateyama et al.

[11] Patent Number: 5,630,983

[45] Date of Patent: May 20, 1997

[54] PRECIPITATION HARDENING STAINLESS STEELS

[75] Inventors: Tomonao Tateyama, Tokai; Tetsuya Shimizu, Nagoya; Michio Okabe, Chita, all of Japan

[73] Assignee: Daido Tokushuko Kabushiki Kaisha, Nagoya, Japan

[21] Appl. No.: 640,122

[22] Filed: Apr. 30, 1996

[30] Foreign Application Priority Data

May 11, 1995 [JP] Japan ..... 7-138827

[51] Int. Cl.[6] ..... C22C 38/42

[52] U.S. Cl. ..... 420/60; 420/61

[58] Field of Search ..... 420/60, 61; 148/326

[56] References Cited

U.S. PATENT DOCUMENTS 629,731 10/1899 Christ et al. ..... 420/61

4,769,213 9/1988 Haswell, Jr. et al. ..... 420/61

*Primary Examiner*—Deborah Yee

*Attorney, Agent, or Firm*—Sughrue, Mion, Zinn, Macpeak & Seas

[57] ABSTRACT

A precipitation hardening stainless steel, which is excellent in cold workability at a solution treated state and good in proof stress after overaging treatment, consists essentially of C≦0.010, Ni 0.010~0.025% (provided C+N≦0.025%), Si≦1.0%, Mn≦1.2%, P≦0.040%, S≦0.030%, Cu: 3.0~5.0%, Ni: 3.0~4.65%, Cr: 13.0~16.5%, Mo≦1.0%, Nb: (−11.43 (C+N)+0.6)~0.5% and the balance Fe on condition that $$452\,(C+N)+11.1\,(Ni+Mn)\leqq 73.1.$$

8 Claims, No Drawings

PRECIPITATION HARDENING STAINLESS STEELS

BACKGROUND OF THE INVENTION

1. Field of the Invention

This invention relates to precipitation hardening stainless steels which are superior in cold workability, and excellent in proof stress in a state being subjected to aging treatment at a temperature higher than peak aging temperature.

2. Description of the Prior Art

As a material for bolts and shafts of various kinds, a precipitation hardening stainless steel has been used, which is specified in JIS G 4303 as SUS 630 corresponding to ASTM 630 and excellent in corrosion resistance and strength.

In a case of manufacturing bolts or so from the conventional SUS 630 steel, the steel is subjected to hot forging. Although the hot forging is easy to work the steel material, the number of steps in the manufacturing process becomes larger since it is required for machinery cuts after that, and there is a problem in the cost.

Therefore, it is desirable to form the steel material into the bolts or so through cold forging. However, SUS 630 steel is hard as much as HRC 35 in a solution treated state (ST-state), and is inferior in cold workability.

Accordingly, as a method for improving the cold workability of SUS 630 steel, reduction of C and N content in the steel has been being studied. Namely, this is a conception to lower the hardness of the parent phase (martensite phase) in the ST-state as compared with that of the conventional SUS 630 steel by decreasing the C and N content in the steel in order to improve the cold workability.

In general, the precipitation hardening stainless steel SUS 630 is so designed as to be brought with high strength by subjecting the steel to aging treatment after the solution treatment and depositing the precipitation hardening phase from the parent phase.

In this case, it is possible to obtain the maximum strength by carrying out peak aging treatment (aging treatment at 480° C.), however there is a problem in that toughness of the steel is lowered by the peak aging treatment. Accordingly, in a case where the toughness is necessary, such a method to ensure the required toughness by subjecting the steel to overaging treatment at a temperature higher than the peak aging temperature (at 620° C., for example) is carried out.

On the other side, there is a problem in that austenite (γ-phase) is precipitated from the parent phase owing to reverse transformation in the case of subjecting the steel to the overaging treatment at a high temperature like this. Namely, if the reverse-transformed austenite of this kind is precipitated, deterioration of the proof stress after the aging treatment becomes remarkable, the strength of the parent phase in the overaging treated state becomes lower than that of the conventional SUS 630 steel especially in the case of the precipitation hardening stainless steel of which the total sum of C and N content is lowered, and it has became clear that there are cases where the proof stress of the steel becomes lower than the value specified in JIS G 4303 owing to the precipitation of the γ-phase.

SUMMARY OF THE INVENTION

It is, therefore, an object of this invention to provide precipitation hardening stainless steels which are possible to solve the aforementioned problems.

The precipitation hardening stainless steel according to this invention is characterized by consisting essentially by weight percentage of not more than 0.010% of C and 0.010 to 0.025% of N with the proviso that the total sum of C and N does not exceed 0.025%, not more than 1.0% of Si, not more than 1.2% of Mn, not more than 0.040% of P, not more than 0.030% of S, 3.0 to 5.0% of Cu, 3.0 to 4.65% of Ni, 13.0 to 16.5% of Cr, not more than 1.0% of Mo, (−11.43 (percent C+percent N)+0.6) to 0.5% of Nb and the balance being substantially Fe with further proviso that C, N, Ni and Mn are correlated such that $$452\ (\text{percent C+percent N})+11.1\ (\text{percent Ni+percent Mn})$$

is at most equal to 73.1, wherein volume percentage of an austenite phase observed after aging treatment is not more than 20%.

DETAILED DESCRIPTION OF THE INVENTION

As described above, the deterioration of the proof stress after aging treatment in the precipitation hardening stainless steel is due to the precipitation of the γ-phase, and the amount of the precipitated γ-phase is very dependent on the amounts of austenite-former elements added in the steel.

The inventors have obtained new information as a results of investigating effect of various elements on the amount of the γ-phase after aging treatment that it is possible to guarantee both the good cold workability and the stated proof stress after the aging treatment (overaging treatment) by regulating the amounts of C, N, Ni and Mn, which are austenite formers, in a well-balanced state and controlling the amounts of Ni and Mn so as not to exceed certain values, respectively.

Additionally, Cu is also an austenite former and an element causing the deterioration of the proof stress at the time of the aging treatment. However, Cu content is not lowered especially in this invention because Cu is an element necessary and indispensable for the precipitation hardening.

This invention is made on basis of the aforementioned information, it is possible to obtain the precipitation hardening stainless steels which are excellent in the cold workability in the ST-state and have good proof stress after the aging treatment according to this invention.

Accordingly, it is possible to improve productivity of the bolts and the other components made of precipitation hardening stainless steels and possible to increase the range of use for the precipitation hardening stainless steels.

Furthermore, it is desirable to add at least one element selected from Ca, B and REM (rare earth metals) in a range of 0.0005 to 0.0100%, respectively in this invention. It is possible to improve the hot workability of the steel by adding these elements.

Next, an explanation will be given in detail about the reason for limiting the chemical composition in the precipitation hardening stainless steel according to this invention.

C: not more than 0.010%

C has an influence on the hardness of the steel in the ST-state (solution treated state) most remarkably, and it is preferable to reduce the C content. The upper limit of C is defined as 0.010% in this invention.

N: 0. 010~0.025%

N also has an effect on the hardness of the steel in the ST-state, and it is preferable to reduce the amount of N but the effect of N is not so remarkable as compared with that of C. Therefore, the minimum N content required for forming carbo-nitrides of Nb by using an affinity of N for Nb and preventing coarsening of the crystal grain is defined in this invention at the same time of reducing the C content. So that, the lower limit of N is defined as 0.010%. Additionally, the more preferable amount of N for obtaining the effect is in a range of 0.015 to 0.025%.

Total sum of C and N: not more than 0.025%.

It is possible to reduce the hardness at the ST-state and possible to improve the cold workability of the steel by decreasing the total amount of C and N. The upper limit of the total amount is defined as 0.025%.

Si: not more than 1.0%

Si is added as a deoxidizer at the time of steel making, however the hot workability of the steel is degraded owing to increase of δ-ferrite if the Si content becomes larger. Therefore, the upper limit of Si is defined as 1.0%.

Mn: not more than 1.2%

Mn is added as a deoxidizer and effective to control the δ-ferrite and to reduce Ni which is expensive. However, Mn is an austenite former, therefore the amount of γ-phase is increased after the overaging treatment when the Mn content is much. Accordingly, the upper limit of Mn is defined as 1.2%. Additionally, the more preferable amount of Mn is in a range of 0.7 to 1.2% for controlling the δ-ferrite and reducing the Ni content.

P: not more than 0.04%

P is apt to be segregated at a grain boundary and has a bad influence upon the strength. and the corrosion resistance, so that it is limited to not more than 0.04%.

S: not more than 0.03%

S worsens the cold workability and the corrosion resistance of the steel, so that it is limited to not more than 0.03%.

Cu: 3.0~5.0%

Cu is an important element for hardening the steel by precipitating ε-phase at the time of aging treatment. It is necessary to add at least 3.0% of Cu in order to obtain such the effect, however excessive addition of Cu increases the amount of the γ-phase at the overaging treatment, causes intergranular embrittlement at a high temperature and is harmful to the hot workability of the steel, so that the upper limit of Cu is defined as 5.0%.

Ni: 3.0~4.65%

Ni is required to be added not less than 3.0% in order to inhibit the δ-ferrite formation and improve the corrosion resistance. However, the amount of the γ-phase increases at the overaging treatment and the proof stress is degraded by adding Ni excessively since Ni is also an austenite former. Accordingly, the upper limit of N is defined as 4.65% in this invention.

Cr: 13.0~16.5%

It is necessary to add Cr not less than 13.0% in order to ensure the corrosion resistance. However, because Cr is a powerful ferrite former element, and the excessive addition of Cr increases the δ-ferrite and harms the hot workability, the upper limit of Cr is defined as 16.5%.

Mo: not more than 1.0%

The excessive addition of Mo causes increase of the δ-ferrite as Mo is also a ferrite former. Therefore, the .upper limit of Mo is restrained up to 1.0% in this invention.

Nb: (−11.43 (percent C+percent N)+0.6)~0.5%

Nb fixes C and N, and lower-the hardness at the ST-state. Further, Nb prevents the crystal grain from coarsening by forming carbo-nitrides. Nb content is decided according to the balance with the total amount of C and N, so that the minimum amount of Nb is defined as (−11.43 (percent C+percent N)+0.6) % in this invention.

However, the upper limit of Nb is defined as 0.50% since the excessive addition elevates the hardness at the ST-state.

$$452\ (\text{percent C+percent N})+11.1\ (\text{percent Ni+percent Mn}) \leqq 73.1$$

As mentioned above, the amount of γ-phase precipitated through the overaging treatment at the temperature higher than 480° C. is affected remarkably by the austenite former elements contained in the steel, and the proof stress of the steel is remarkably degraded when the amount of γ-phase exceeds 20% in volume. In this invention, it is possible to reduce the γ-phase after the overaging treatment not more than 20% by controlling the austenite formers C, N, Ni and Mn so as to satisfy the above-mentioned relationship, and possible to obtain favorable proof stress even when the overaging treatment is performed.

Ca, B, REM: 0.0005~0.0100%

It is possible to improve the hot workability by adding these elements in a small amount. However, the excessive addition of these elements rather deteriorates the hot workability, so that the amounts of these elements are defined in ranges of 0.0005 to 0.0100%, respectively.

EXAMPLE

Next, the invention will be described in detail with reference to the following examples and comparative examples.

Stainless steels of 50 kg having chemical compositions as shown in Table 1 were melted respectively in a vacuum induction furnace. Obtained ingots were subjected to hot forging at 1200° C. and beaten into round rods of 20 mm in diameter. After this, the round rods were subjected to the solution treatment (ST) by heating at 1040° C. for 30 min. and quenching into water, and the hardness was measured with respect to the respective solution treated round rods.

TABLE 1

| | Chemical composition (wt %) | | | | | | | | | | | | | Value calculated from |
|---|---|---|---|---|---|---|---|---|---|---|---|---|---|---|
| Steel No. | C | Si | Mn | P | S | Cu | Ni | Cr | Mo | N | Nb | Al | C + N others | Formula* |
| Inventive steel | | | | | | | | | | | | | | |
| 1 | 0.002 | 0.15 | 0.95 | 0.026 | 0.002 | 3.32 | 4.50 | 15.64 | 0.01 | 0.022 | 0.34 | 0.005 | 0.024 | 71.3 |
| 2 | 0.005 | 0.17 | 0.95 | 0.026 | 0.002 | 3.20 | 4.48 | 15.5 | 0.01 | 0.018 | 0.37 | 0.004 | 0.023 | 70.7 |

TABLE 1-continued

| Steel No. | Chemical composition (wt %) | | | | | | | | | | | | | | Value calculated from |
|---|---|---|---|---|---|---|---|---|---|---|---|---|---|---|---|
| | C | Si | Mn | P | S | Cu | Ni | Cr | Mo | N | Nb | Al | C + N | others | Formula* |
| 3 | 0.006 | 0.16 | 0.96 | 0.027 | 0.002 | 3.23 | 4.60 | 15.5 | 0.01 | 0.016 | 0.38 | 0.004 | 0.022 | Ca: 0.0010 | 71.7 |
| 4 | 0.005 | 0.15 | 0.95 | 0.025 | 0.003 | 3.32 | 4.40 | 15.64 | 0.01 | 0.016 | 0.38 | 0.005 | 0.021 | B,REM: 0.0014 | 68.9 |
| 5 | 0.005 | 0.14 | 0.95 | 0.024 | 0.004 | 3.10 | 4.20 | 15.5 | 0.01 | 0.018 | 0.36 | 0.005 | 0.023 | | 67.6 |
| 6 | 0.006 | 0.08 | 0.95 | 0.026 | 0.002 | 3.25 | 4.30 | 15.5 | 0.01 | 0.017 | 0.34 | 0.004 | 0.023 | | 68.7 |
| 7 | 0.005 | 0.51 | 0.95 | 0.028 | 0.002 | 3.05 | 4.48 | 15.58 | 0.01 | 0.018 | 0.35 | 0.005 | 0.023 | | 70.7 |
| 8 | 0.004 | 0.89 | 0.95 | 0.026 | 0.001 | 4.23 | 4.61 | 15.45 | 0.01 | 0.018 | 0.37 | 0.004 | 0.022 | | 71.7 |
| 9 | 0.006 | 0.08 | 0.71 | 0.026 | 0.002 | 3.12 | 4.52 | 15.7 | 0.01 | 0.019 | 0.35 | 0.005 | 0.025 | | 69.4 |
| 10 | 0.005 | 0.44 | 1.15 | 0.028 | 0.002 | 3.35 | 4.45 | 15.53 | 0.01 | 0.018 | 0.33 | 0.005 | 0.023 | | 72.6 |
| 11 | 0.006 | 0.18 | 0.95 | 0.026 | 0.002 | 3.10 | 4.57 | 15.46 | 0.01 | 0.016 | 0.35 | 0.005 | 0.022 | | 71.2 |
| 12 | 0.005 | 0.14 | 0.95 | 0.024 | 0.003 | 4.30 | 4.34 | 14.2 | 0.28 | 0.017 | 0.37 | 0.004 | 0.022 | | 68.7 |
| 13 | 0.004 | 0.14 | 0.95 | 0.025 | 0.002 | 3.28 | 4.33 | 16.2 | 0.85 | 0.018 | 0.36 | 0.005 | 0.022 | | 68.6 |
| Comparative steel | | | | | | | | | | | | | | | |
| C1 | 0.025 | 0.15 | 0.94 | 0.024 | 0.001 | 3.20 | 4.45 | 15.5 | 0.01 | 0.017 | 0.35 | 0.005 | 0.042 | | 78.8 |
| C2 | 0.007 | 0.15 | 0.94 | 0.026 | 0.002 | 3.30 | 4.40 | 15.6 | 0.01 | 0.031 | 0.36 | 0.004 | 0.038 | | 76.5 |
| C3 | 0.005 | 0.15 | 0.94 | 0.025 | 0.001 | 3.20 | 5.10 | 15.5 | 0.01 | 0.019 | 0.35 | 0.003 | 0.024 | | 77.9 |
| C4 | 0.006 | 0.15 | 1.6 | 0.026 | 0.002 | 3.31 | 4.40 | 15.63 | 0.01 | 0.018 | 0.33 | 0.006 | 0.024 | | 77.4 |

*452 (percent C + percent N) + 11.1 (percent Ni + percent Mn)

Furthermore, a specimen of 15 mm in diameter and 22.5 mm in height was cut out from each of the solution treated rods and a compressive test was performed using the specimen to measure compressive stress at the time when $\epsilon$ gets to 1.

$\epsilon$ is a strain defined by the following equation:

$$\epsilon = \ln \frac{Ho - H}{Ho}$$

where Ho is original height of the specimen, H is height of the specimen after compression.

In addition to above, the rods were subjected to the aging treatment under condition of cooling in air after being heated at 620° C. for 240 minutes, the hardness of respective aging treated rods was measured and the proof stress of the rods was measured by carrying out the tensile test. Furthermore, the amount of the retained and precipitated austenite after the aging treatment was obtained according to integrated intensity ratio at peak of (200) plane /α (211) using an X-ray diffractometer.

The obtained results are shown in Table 2.

TABLE 2

| Steel No. | Solution treatment | | Aging treatment at 620° C. | | |
|---|---|---|---|---|---|
| | Hardness (HRC) | Compressive stress (MPa) | Hardness (HRC) | Austenite (%) | Proof stress (MPa) |
| Inventive steel | | | | | |
| 1 | 25.7 | 875 | 30.1 | 15.3 | 782 |
| 2 | 26.5 | 923 | 31 | 17.3 | 767 |
| 3 | 27 | 933 | 30.9 | 18.7 | 757 |
| 4 | 26 | 931 | 31.2 | 16.2 | 776 |
| 5 | 26.1 | 928 | 30.8 | 14.1 | 791 |
| 6 | 26.7 | 929 | 30.4 | 15.6 | 780 |
| 7 | 26.5 | 922 | 30.9 | 17.1 | 769 |
| 8 | 26.7 | 925 | 31.3 | 17.9 | 763 |
| 9 | 26.6 | 930 | 31.4 | 18.5 | 758 |
| 10 | 26.3 | 935 | 31.1 | 18.0 | 762 |
| 11 | 26.3 | 920 | 30.9 | 18.6 | 758 |
| 12 | 26.8 | 926 | 30.9 | 15.6 | 780 |
| 13 | 26.4 | 931 | 31.4 | 14.7 | 787 |
| Comparative steel | | | | | |
| C1 | 32.3 | 1128 | 30 | 33.5 | 688 |
| C2 | 30.1 | 994 | 30.2 | 27.2 | 695 |
| C3 | 26.2 | 933 | 28.2 | 26.1 | 701 |
| C4 | 26.5 | 929 | 27.9 | 24.3 | 715 |

In the comparative steels C1 and C2 of which C and N content is beyond the limits defined in this invention as shown in Table 1, the hardness and the compressive stress at the ST-state are high, therefore the both steel are evaluated to be inferior in the cold workability. Furthermore, large amounts of the γ-phase are precipitated and retained through the aging treatment at 620° C. and the proof stress after the aging treatment shows merely low values.

The comparative steels C3 and C4 are beyond the limits of this invention in the Ni content and the Mn content respectively, further in the relationship between C, N, Ni and Mn (austenite formers). Consequently, the γ-phase increases in quantity and the proof stress in the tensile test becomes lower than 726 MPa specified in JIS G 4303 through the aging treatment.

As compared with above, in the inventive steels No. 1~13, the hardness at the ST-state is low in any case, the compressive stress in the compressive test shows low values, therefore these steels can be evaluated to be excellent in the cold workability.

Furthermore, it is confirmed that the amount of the γ-phase precipitated and retained through the aging treatment shows low values not more than 20% in all cases, consequently it is possible to obtain the proof stress higher than 726 MPa specified in JIS as a result of the tensile test.

As the other example of this invention, hexagon head bolts with 8 mm in major diameter and 33 mm in nominal length were manufactured from a stainless steel containing 0.005% of C, 0.19% of Si, 0.88% of Mn, 0.024% of P, 0.008% of S, 3.31% of Cu, 4.30% of Ni, 15.61% of Cr, 0.03% of Mo, 0.018% of N, 0.35% of Nb and 0.0025% of Ca.

Namely, the bolts were formed through cold forging and thread rolling by a bolt former machine using the material steel subjected to the solution treatment at 1040° C., then the bolts were subjected to the aging treatment at 620° C. after being formed.

The bolts with satisfactorily high accuracy in sizes and shapes were obtained without cracking. It was confirmed as results of tensile tests of the bolts that the bolts were fractured from the threaded portions (not from the heads) in all cases, and sufficiently excellent in the strength (970 MPa, 986 MPa, 968 MPa and 996MPa).

Although the preferred examples of this invention has been described above in detail, this invention is not limited to the above-mentioned examples, it is possible to practice the invention in various forms without departing from the spirit and scope of this invention.

As mentioned above, according to this invention, it is possible to obtain precipitation hardening stainless steels superior in cold workability in a ST-state and excellent in proof stress even after the aging treatment.

Accordingly, it is possible to improve productivity of the bolts and the other components made of precipitation hardening stainless steels and possible to increase the range of use for the precipitation hardening stainless steels.

What is claimed is:

1. A precipitation hardening stainless steel for cold working consisting essentially by weight percentage of not more than 0.010% of C and 0.010 to 0.025% of N with the proviso that the total sum of C and N does not exceed 0.025%, not more than 1.0% of Si, not more than 1.2% of Mn, not more than 0.040% of P, not more than 0.030% of S, 3.0 to 5.0% of Cu, 3.0 to 4.65% of Ni, 13.0 to 16.5% of Cr, not more than 1.0% of Mo, (−11.43 (percent C+percent N)+0.6) to 0.5% of Nb and the balance being substantially Fe with further proviso that C, N, Ni and Mn are correlated such that $$452\ (\text{percent C}+\text{percent N})+11.1\ (\text{percent Ni}+\text{percent Mn})$$

is at most equal to 73.1, wherein volume percentage of an austenite phase observed after aging treatment is not more than 20%.

2. A precipitation hardening stainless steel for cold working consisting essentially by weight percentage of not more than 0.010% of C and 0.010 to 0.025% of N with the proviso that the total sum of C and N does not exceed 0.025%, not more than 1.0% of Si, not more than 1.2% of Mn, not more than 0.040% of P, not more than 0.030% of S, 3.0 to 5.0% of Cu, 3.0 to 4.65% of Ni, 13.0 to 16.5% of Cr, not more than 1.0% of Mo, (−11.43 (percent C+percent N)+0.6) to 0.5% of Nb, at least one element selected from 0.0005 to 0.0100% of Ca, 0.0005 to 0.0100% of B and 0.0005 to 0.0100% of rare earth metals and the balance being substantially Fe with further proviso that C, N, Ni and Mn are correlated such that $$452\ (\text{percent C}+\text{percent N})+11.1\ (\text{percent Ni}+\text{percent Mn})$$

is at most equal to 73.1, wherein volume percentage of an austenite phase observed after aging treatment is not more than 20%.

3. A precipitation hardening stainless steel for cold working according to claim 1, wherein N is not less than 0.015%.

4. A precipitation hardening stainless steel for cold working according to claim 2, wherein N is not less than 0.015%.

5. A precipitation hardening stainless steels for cold working according to claim 1, wherein mn is not less than 0.7%.

6. A precipitation hardening stainless steel for cold working according to claim 2, wherein Mn is not less than 0.7%.

7. A precipitation hardening stainless steels for cold working according to claim 3, wherein Mn is not less than 0.7%.

8. A precipitation hardening stainless steel for cold working according to claim 4, wherein Mn is not less than 0.7%.

* * * * *